United States Patent [19]

Costen

[11] 4,099,452

[45] Jul. 11, 1978

[54] SMOKESTACK-MOUNTED AIRFOIL

[76] Inventor: Robert C. Costen, 211 Greenwell Dr., Hampton, Va. 23666

[21] Appl. No.: 630,582

[22] Filed: Nov. 10, 1975

[51] Int. Cl.[2] ..... E04F 17/02; F23L 17/02

[52] U.S. Cl. ..... 98/58; 239/2 R; 239/14; 110/184; 114/187

[58] Field of Search ..... 98/58–60, 98/82; 239/550, 562, 2 R, 14; 126/307 R, 307 A; 110/184; 114/15, 187; 104/52

[56] References Cited

U.S. PATENT DOCUMENTS

| | | | |
|---|---|---|---|
| 432,544 | 7/1890 | Moore | 98/58 |
| 1,849,812 | 3/1932 | Spencer | 98/78 |
| 2,610,570 | 9/1952 | Valensi | 114/187 |
| 2,847,927 | 8/1958 | Veyssiere | 114/187 |
| 3,115,820 | 12/1963 | Adelt | 98/60 |
| 3,342,023 | 9/1967 | Fleming | 98/58 |
| 3,589,603 | 6/1971 | Fohl | 98/58 |
| 3,643,581 | 2/1972 | Feldman | 98/58 |
| 3,904,127 | 9/1975 | Cash | 98/58 |

FOREIGN PATENT DOCUMENTS

| | | | |
|---|---|---|---|
| 484,776 | 7/1952 | Canada | 110/184 |
| 1,229,210 | 9/1960 | France | 98/60 |

OTHER PUBLICATIONS

Elementary Fluid Mechanics by John K. Vennard, pp. 318–327.

*Primary Examiner*—William F. O'Dea
*Assistant Examiner*—Henry C. Yuen
*Attorney, Agent, or Firm*—Howard J. Osborn; John R. Manning

[57] ABSTRACT

A system for improving the effluent dispersal characteristics of smokestacks subject to relative winds comprising a vortex generating airfoil attached to a smokestack near the stack gas exit. Relative winds passing over the airfoil create strong vortices which entrain and hold together smokestack effluents until the vortices deteriorate. The vortex flow direction and angle of ascension may be controlled in order to achieve optimum effluent dispersal by varying the airfoil angle of attack.

21 Claims, 12 Drawing Figures

SMOKESTACK-MOUNTED AIRFOIL

ORIGIN OF THE INVENTION

The invention described herein was made by an employee of the U.S. Government and may be manufactured and used by or for the Government for governmental purposes without the payment of any royalties thereon or therefor.

BACKGROUND OF THE INVENTION

This invention relates generally to smokestack effluent dispersal systems and more particularly to a smokestack-mounted, vortex-generating airfoil which converts the kinetic energy of winds blowing by a smokestack into a plurality of vortices which entrain the stack effluents such that effluent dispersal may be controlled by controlling the flow direction of the vortices.

DESCRIPTION OF THE PRIOR ART

Presently, smokestacks rely on the vertical momentum and natural buoyancy of hot stack gases to carry effluents aloft for dispersion. This system works well in no wind or light wind (e.g., less than 5 miles per hour) conditions, but its effectiveness deteriorates when winds become stronger.

As wind strength increases, stack effluents tend to exit a smokestack and immediately trail off downwind in a long, generally horizontal flow near the ground, due to the fact that the plume becomes partially entrained in the eddying wake of the smokestack and neutrally buoyant air is rapidly entrained in the stack gas plume. These phenomena result in high ground level pollution downstream of the smokestack. Prior to this invention the most satisfactory method of reducing downstream ground level pollution was to build a higher smokestack and to increase vertical stack gas momentum in order to achieve sufficient smoke plume elevation for good dispersal characteristics. Presently available chimney cowls and ventilators function only to keep water out of a smokestack or to aid in the extraction of stack gases by creating a low pressure area in the vicinity of the stack gas exit.

A further disadvantage of presently available smokestacks is the lack of any control over the direction of effluent flow when a stack is subject to relative winds. In such conditions the smoke plume flows directly downstream from the stack and cannot be directed around areas which should not be subject to large amounts of pollution.

SUMMARY OF THE INVENTION

Accordingly, one object of this invention is to provide a smokestack effluent dispersal system for deflecting the effluents of a smokestack subject to relative winds upwards, substantially above the level of the stack gas exit in order to minimize downstream ground level pollution.

Another object of the present invention is to provide a smokestack effluent dispersal system by means of which the azimuthal flow direction of stack effluents can be controlled.

A further object of this invention is to provide a smokestack effluent dispersal system which obviates the necessity of building smokestacks taller solely to achieve satisfactory effluent dispersal on windy days.

Yet another object of the present invention is to contain stack effluents for a substantial distance downstream of the smokestack in order to prevent or reduce effluent fallout in the immediate vicinity of the stack.

According to one embodiment of the present invention, the foregoing and other objects are attained by providing a negative lift airfoil comprised of two cantilevered airfoil sections mounted on the sides of a smokestack immediately below the stack gas exit. The airfoil is mounted such that the leading edge of the airfoil is perpendicular to and facing into the prevailing wind direction and the chord has a negative angle of attack with respect to the wind. A positive dihedral angle is provided in order to elevate the airfoil tips above the level of the stack gas exit.

As the relative winds flow over the airfoil, strong counter-rotating tip vortices are formed. These vortices rise due to their mutual interaction as they move downstream with the wind while simultaneously creating a zone of recirculating air around both vortices. This recirculation zone is effectively isolated from the surrounding free airstream due to its circular motion. Smokestack effluents become entrained in these rising vortices and the surrounding air recirculation zone upon exiting the stack and are carried upwards as the vortices move downwind. The swirling action of the vortices serves to contain the stack effluents as well as causes them to rise. Actual effluent dispersion begins when the vortices deteriorate, usually several miles downstream, whereupon the effluents are dispersed as they normally would be in a free airstream.

Various other objects and advantages of this invention will appear from the following detailed description of several embodiments thereof when considered in connection with the accompanying drawings.

DESCRIPTION OF THE PREFERRED EMBODIMENT

Figure 2:
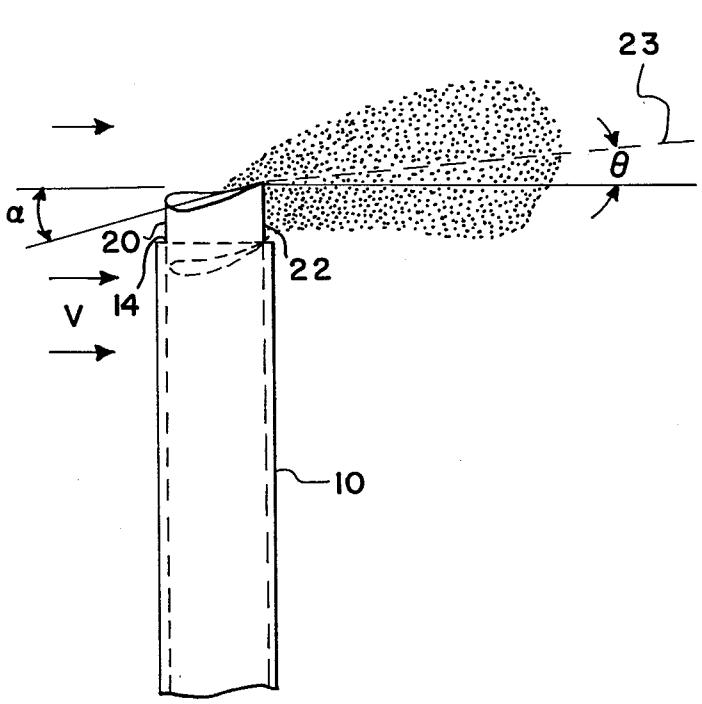
FIG. 2 is a side elevation view of the embodiment of FIG. 1.

Referring now to the drawings wherein like reference characters designate identical or corresponding parts throughout the several views, and more particularly to FIGS. 1 and 2, a negative lift airfoil, designated generally by the reference numeral 12 and composed of airfoil sections 16 and 18, is fixedly mounted on a smokestack 10 immediately below the stack gas exit 14 of the smokestack such that the airfoil 12 faces into the prevailing winds. Airfoil sections 16 and 18 are termed a negative lift airfoil due to the fact that their surfaces of greatest convex curvature face downward and leading edges 20 are lower relative to the free airstream than trailing edges 22, thus a downward force is generated. Airfoil sections 16 and 18 are mounted in diametrically opposed relationship and extend outwardly and upwardly from smokestack 10, thus forming an angle $\gamma$, hereinafter referred to as the dihedral angle, with a horizontal reference plane. Airfoil section 16 and 18 are also mounted such that the leading edge 20 is lower than the trailing edge 22, thus the chords of airfoil sections 16 and 18 form an angle of attack $\alpha$ with a horizontal reference plane and horizontal winds, depicted schematically by the arrows at V (FIG. 2).

Airfoil sections 16 and 18 may be constructed of aluminum alloy, composite materials or other workable substances according to existing aircraft technology. Furthermore, airfoils 16 and 18 may be constructed in any workable cross-sectional and wingtip configuration capable of generating strong tip vortices when exposed to relative winds.

Figure 1:
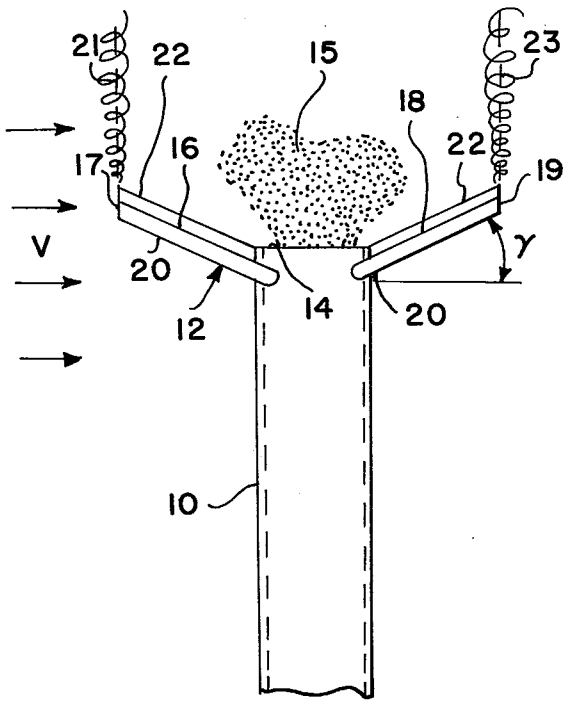
FIG. 1 is a front elevation view of a negative lift airfoil constructed according to the present invention mounted on the sides of a smokestack immediately below the stack gas exit.
Figure 4:
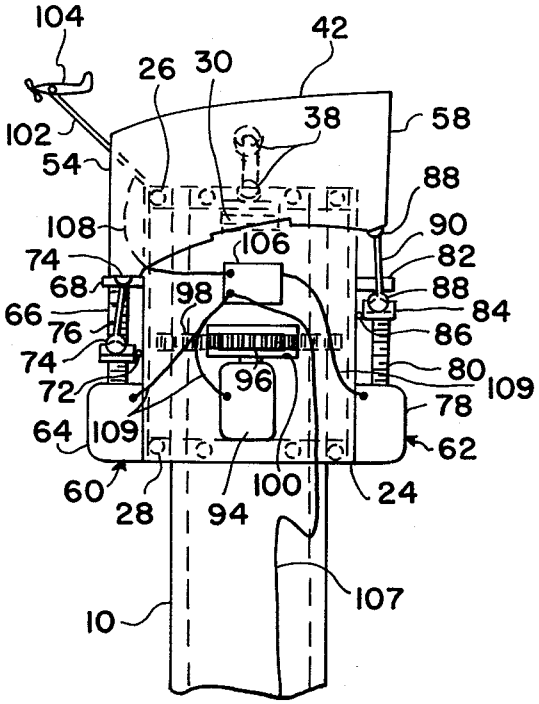
FIG. 4 is a side elevation view of the embodiment of FIG. 3.
Figure 3:
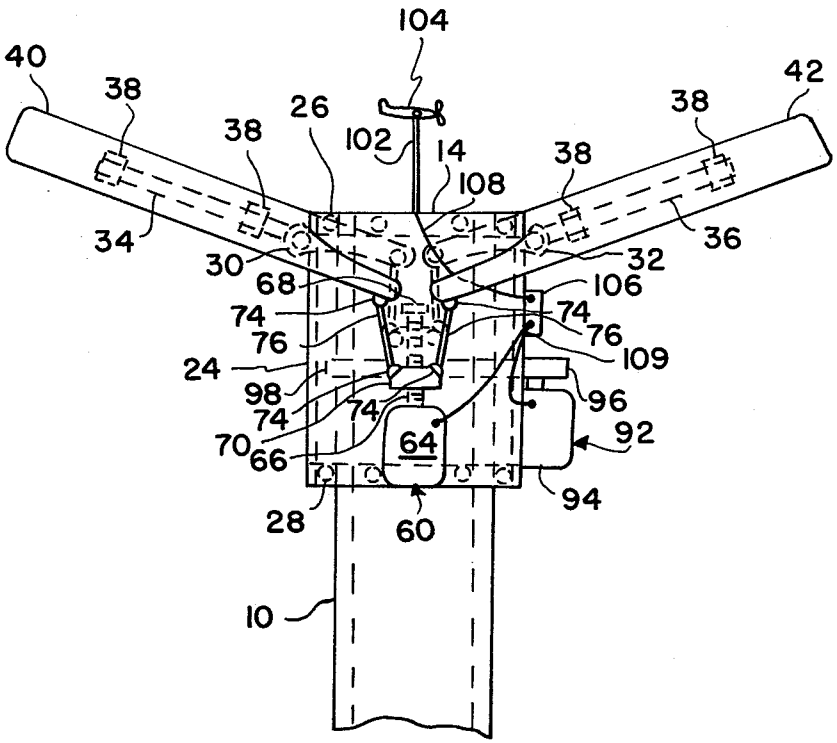
FIG. 3 is a front elevation view of a negative lift airfoil mounted on a smokestack and having angle of attack, dihedral angle and azimuth controls.
Figure 5:
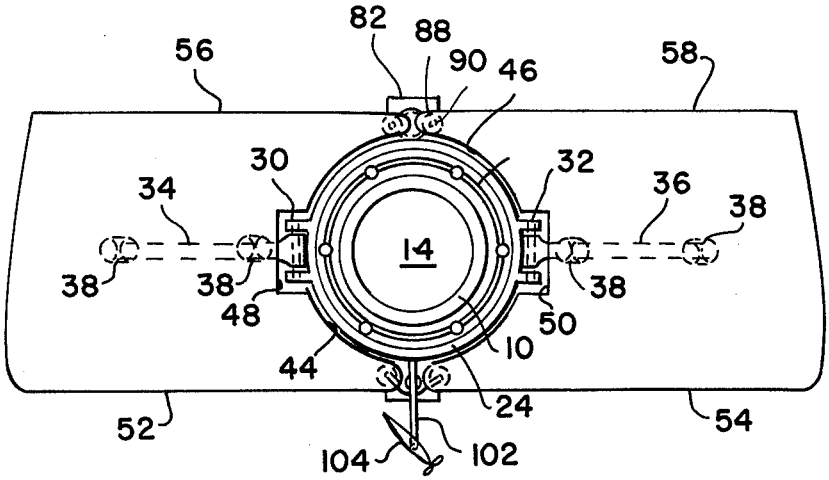
FIG. 5 is a plan view of the embodiment of FIG. 3.

FIGS. 3, 4 and 5 show an alternate embodiment, similar to that shown in FIGS. 1 and 2, incorporating means of manually varying azimuthal orientation, angle of attack and dihedral angle from a ground level control station. In the alternate embodiment of FIGS. 3 and 4, cylindrical carriage 24, constructed of steel or other suitable material, is rotatably mounted on smokestack 10 by means of upper and lower antifriction bearings 26 and 28. Carriage 24 is positioned axially on smokestack 10 such that its upper end is approximately level with the plane of stack gas exit 14.

Extending in diametrical opposition from the sides of carriage 24 immediately below its upper end are brackets 30 and 32. Airfoil support rods 34 and 36 are pivotally mounted in brackets 30 and 32 such that rods 34 and 36 are free to describe a vertical arc about their respective mounting brackets. A plurality of airfoil support bearings 38 mounted on rods 34 and 36 engage airfoil sections 40 and 42 such that airfoil sections 40 and 42 are free to pivot about rods 34 and 36. Bearings 38 have both radial and thrust loading capabilities in order to withstand the loads generated by airfoil sections 40 and 42.

Airfoil sections 40 and 42 may be constructed of aluminum alloy, composite material or other workable substances and may be made in any cross sectional and wingtip configuration capable of generating strong vortical flow at low relative air speeds. In the embodiment of FIGS. 3–5, the chord length of airfoil sections 40 and 42 is greater than the diameter of cylindrical carriage 24; however, it should be understood that the chord dimension is in no way constrained to be larger than the carriage diameter, as many airfoil sections having chords smaller than the carriage diameter will produce the desired vortical flow. An airfoil having a smaller chord than the carriage diameter would require dihedral and angle of attack adjustment linkages different from that described hereinbelow; however, such linkage modifications as would be necessary are well within the scope of one skilled in the mechanical and aeronautical arts.

The inboard edges, or wing roots, of airfoil sections 40 and 42 are provided with semicircular recesses 44 and 46 (FIG. 5), respectively, which are of sufficiently large radius to provide clearance between the airfoil sections and cylindrical carriage 24 at the maximum anticipated dihedral angle or angle of attack excursion. Similarly, clearance is provided between the airfoil sections and brackets 30 and 32 by means of rectangular recesses 48 and 50.

The dihedral angle and angle of attack of airfoil sections 40 and 42 are varied by changing the vertical position of the airfoil leading edges 52 and 54 and trailing edges 56 and 58 by means of a leading edge drive, indicated generally by the reference numeral 60, and a trailing edge drive, indicated generally by the reference numeral 62. Leading edge drive 60 is mounted on carriage 24 immediately below the inboard leading edges of airfoil sections 40 and 42 and consists of a reversible drive motor 64 having a driven screw shaft 66 extending vertically upward therefrom. The upper end of screw shaft 66 is supported by a bearing 68 mounted on carriage 24. Riser nut 70 threadably engages screw shaft 66 between bearing 68 and drive motor 64. Riser nut 70 is equipped with a boss 72 which slidably engages carriage 24 and prevents rotation of riser nut 70 upon rotation of screw shaft 66. Riser nut 70 is separately connected to the inboardmost leading edges of airfoil sections 40 and 42 by means of ball joints 74 and connecting links 76. Trailing edge drive 62 is identically configured and consists of reversible drive motor 78, screw shaft 80, riser nut 84 with boss 86, and ball joints 88 and connecting links 90 which connect riser nut 84 to the inboard ends of the trailing edges of airfoil sections 40 and 42.

The dihedral angle of airfoil section 40 and 42 is varied by simultaneously raising or lowering the inboard leading edges 52 and 54 and trailing edges 56 and 58 over equal displacements by means of leading edge drive 60 and trailing edge drive 62. Angle of attack adjustment is accomplished by simultaneously moving the inboard leading edges and trailing edges over equal displacements in opposite directions via leading edge drive 60 and trailing edge drive 62 (e.g., the angle of attack is increased by lowering the airfoil leading edges 52 and 54 while simultaneously raising trailing edges 56 and 58). Angle of attack and dihedral angle adjustments will be more fully explained hereinbelow.

Azimuthal orientation is achieved by rotating the entire carriage and wing structure by means of an azimuth drive, indicated generally by the reference numeral 92. Azimuth drive 92 is comprised of an reversible drive motor 94 mounted on carriage 24 and connected to pinion gear 96. Pinion gear 96 engages ring gear 98, which is fixedly attached to smokestack 10, through a suitable aperture 100 in carriage 24.

Extending upward from the top of carriage 24 above the leading edges of airfoil sections 40 and 42 is a stalk 102 upon which is mounted a wind speed and direction sensor 104. Sensor 104 provides wind data to an operator on the ground via cables 108 and 107 and junction box 106. Operating power for leading and trailing edge drive motors 64 and 78 and azimuthal drive motor 94 is supplied by cable 107, junction box 106 and cables 109. It should be noted that the embodiment of FIGS. 3–5 may be provided with an automatic control system if desired.

Figure 6:
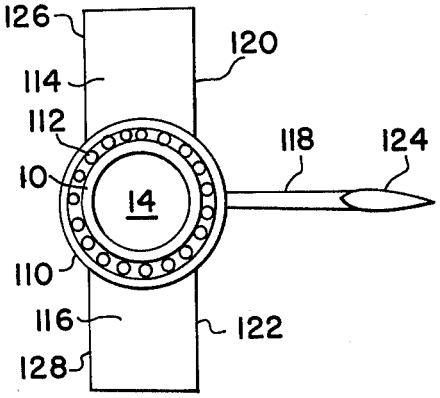
FIG. 6 is a plan view of a negative lift airfoil mounted on a rotatable base attached to a smokestack by means of an antifriction bearing and having a vertical tail fin attached to the rotatable base in order to orient the airfoil into the relative wind.

A further embodiment of the present invention incorporating variable azimuthal orientation and a negative lift airfoil having a fixed angle of attack and dihedral angle is shown in FIG. 6. Rotatable cylindrical carriage 110 is revolvably mounted on smokestack 10 immediately below the stack gas exit 14 by means of a roller bearing 112. Negative lift airfoil sections 114 and 116 are fixedly mounted in diametrical opposition on the sides of carriage 110 at fixed dihedral angles and angles of attack suitable for the anticipated wind conditions as will be hereinafter explained. Tail boom 118 is mounted perpendicular to the span axis of airfoil sections 114 and 116 on carriage 110 midway between airfoil trailing edges 120 and 122 and extends outwardly in a generally horizontal direction. Symmetrical vertical fin 124 is affixed to the end of boom 118 such that its chord axis is alined with the axis of boom 118. Vertical fin 124 functions to keep the leading edges 126 and 128 of airfoil sections 114 and 116 facing into and perpendicular to relative winds flowing past the smokestack.

Figure 7:
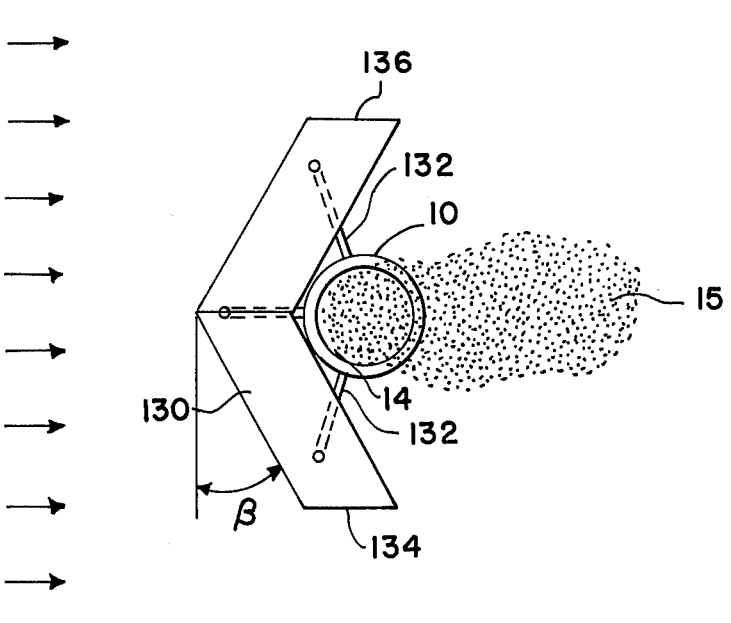
FIGS. 7 and 8 are plan and side elevation views, respectively, of a continuous sweptback airfoil section mounted on struts above the stack gas exit of a smokestack.
Figure 8:
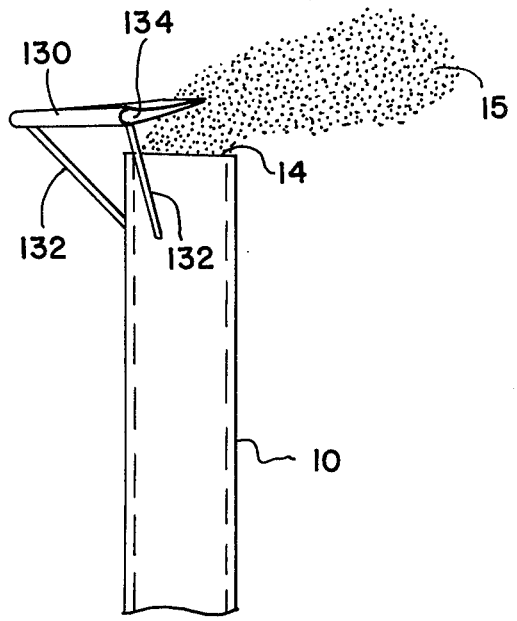

Yet another embodiment of the present invention is set forth in FIGS. 7 and 8. According to this embodiment, a swept-back negative lift airfoil 130 is fixedly mounted on struts 132 above the stack gas exit 14 of a smokestack 10. The azimuthal orientation and angle of attack of airfoil 130 are fixed such that the airfoil faces into the prevailing winds and the angle of attack is fixed at the optimum angle for the anticipated wind conditions. Airfoil 130 employs a zero dihedral angle as wind-tips 134 and 136 are sufficiently elevated above stack gas exit 14 to result in satisfactory vortical entrainment of stack effluents as will be hereinafter explained. Airfoil 130 also employs a sweepback angle $\beta$ in order that it may be mounted upstream of the smokestack, relative to the prevailing wind direction while maintaining wingtips 134 and 136 in an optimum position for entraining effluents and not obstructing the vertical flow of effluents from stack gas exit 14 on windless days.

Figure 9:
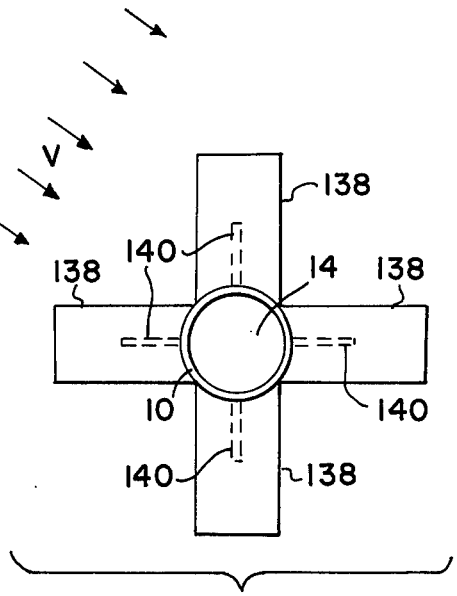
FIG. 9 is a plan view of four horizontal, coplanar airfoil sections mounted immediately below the stack gas exit of a smokestack in diametrically opposed pairs having a right angle between span axes.

A still further embodiment of the present invention is set forth in FIG. 9. In this embodiment, negative lift airfoil sections 138 are pivotally mounted on smoke stack 10 on axles 140 immediately below the stack gas exit 14 in diametrically opposed pairs, each pair having its span axis at right angles to the other pair. Airfoil sections 138 are designed for airflow in either chordal direction, therefore negative lift is achieved regardless of wind direction by varying the angle of attack of each airfoil by hydraulic or mechanical means similar to that employed in the embodiment set forth in FIGS. 3–5.

Figure 11:
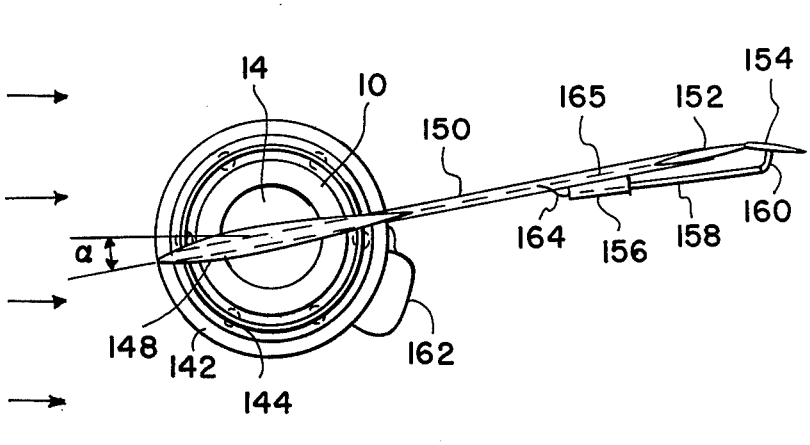
FIG. 11 is a plan view of the embodiment of FIG. 10.
Figure 10:
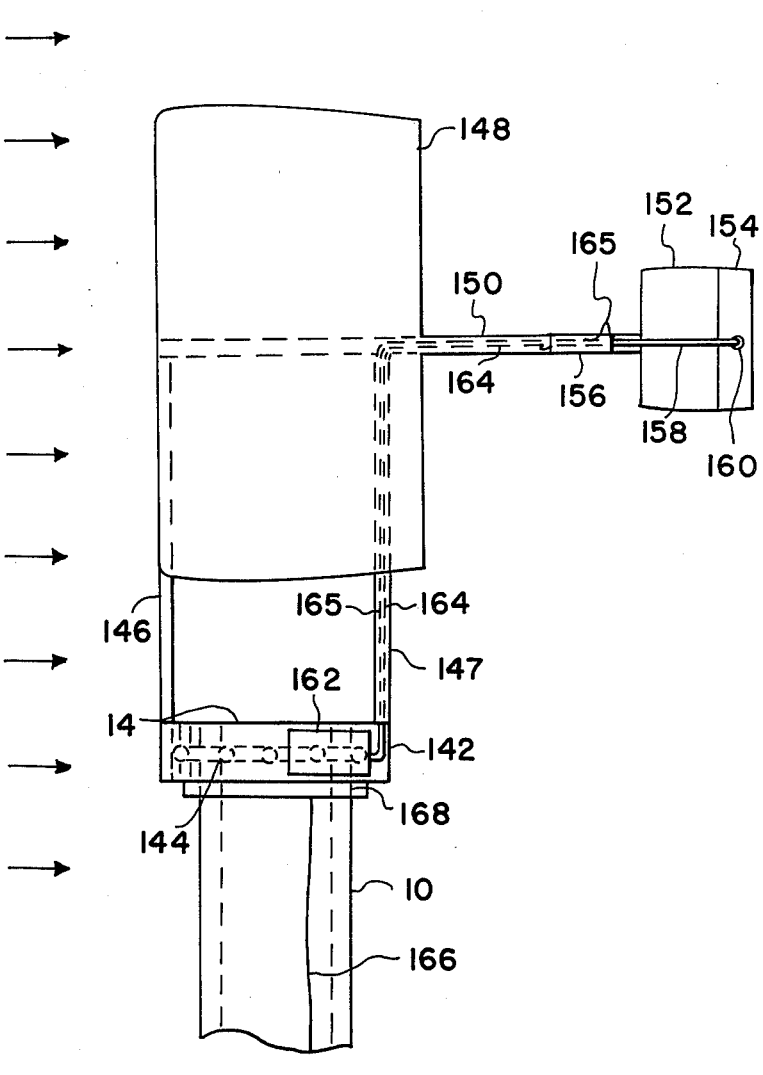
FIG. 10 is an elevation view of a rotatable vertical airfoil having a trim tab equipped tail fin for controlling the airfoil angle of attack with the relative wind.

A vertical airfoil, horizontal lift embodiment of the present invention which achieves controlled horizontal dispersion of effluents, is shown in FIGS. 10 and 11. Carriage 142 is rotatably mounted on smokestack 10, such that its upper edge is approximately level with stack gas exit 14, by means of anti-friction bearing 144. Extending vertical from carriage 142 are struts 146 and 147 upon which is mounted vertical, symmetrically sectioned airfoil 148. Extending horizontally from the trailing edge of airfoil 148 is boom 150. Boom 150 is alined with the chord of airfoil 148 and is fixedly attached to the upper ends of struts 146 and 147 within airfoil 148. Fixedly mounted on the furthest extension of boom 150 such that its chord is alined with the axis thereof is vertical fin 152. Rudder 154 is pivotably mounted on the trailing edge of vertical fin 152 and serves to vary and control the angle of attack $\alpha$ of airfoil 148. Rudder control is provided by double-acting hydraulic actuating cylinder 156 which is connected to rudder 154 via cylinder rod 158 and crank arm 160. Hydraulic pump 162 is mounted on carriage 142 and supplies operating pressure to cylinder 156 via hydraulic pipe lines 164 and 165 which are routed within strut 147 and boom 150. Rudder 154 is positioned to achieve a desired angle of attack by balancing hydraulic pressures at both ends of double acting cylinder 156. Control signals and power are supplied to pump 162 by means of cable 166 and slip ring 168.

Figure 12:
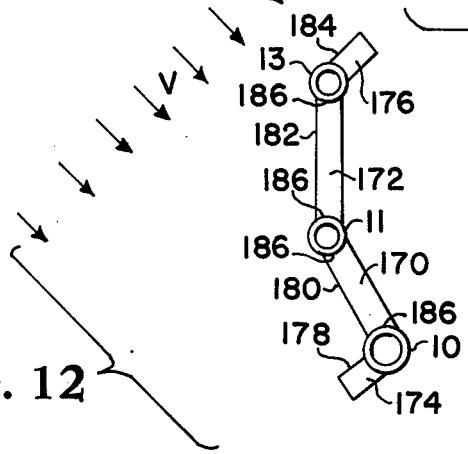
FIG. 12 is a plan view of the series of smokestacks interconnected by negative lift airfoils with the two end stacks having cantilevered airfoil sections mounted thereon.

Yet another embodiment of the present invention is shown in FIG. 12. This embodiment relates to providing vortex generating airfoils for a series of juxtapositional smokestacks 10, 11 and 13 in approximate alinement by connecting the smokestacks together in order of their alinement with negative lift airfoils 170 and 172 mounted immediately below the stack gas exits of the smokestacks. Cantilevered airfoils 174 and 176 are also provided on each end smokestack 10 and 13. Airfoils 170, 172, 174 and 176 are positioned such that their leading edges 178, 180, 182 and 184 face the direction from which the prevailing winds most often blow. Airfoils may be provided with either a fixed angle of attack or an angle of attack which is variable in a manner similar to that taught hereinabove.

OPERATION

All embodiments of the present invention function to improve smokestack effluent dispersal on windy days by entraining effluents in a plurality of vortices which trail off for substantial distances downwind before disintegrating, thus heavy ground-level pollution immediately downstream of the stack is avoided. The generally horizontal, negative lift airfoil embodiments improve dispersion by generating vortices which rise above the level of the smokestack gas exit as they move downstream, whereas the vertical airfoil embodiments enable the smokestack operator to control to a limited extent the azimuthal direction in which the vortices, hence stack effluents, flow.

In operation, the embodiment of FIGS. 1 and 2 is oriented such that the airfoil leading edge 20 is facing into and generally perpendicular to the prevailing winds at the smokestack site. As wind passes over airfoil sections 16 and 17, a negative lift, or in other words, a downward force, is developed by the airfoil sections. This creation of negative lift results in an upward deflection of wind passing over the airfoil and the creation of rising, counter-rotating wingtip vortices indicated schematically at 21 and 23. As regards aerodynamic behavior, the airfoils of the present invention behave much like conventional aircraft wings.

Wingtip vortices 21 and 23 result from high pressure air on the upper surfaces of airfoil sections 16 and 18 attempting to travel around wingtips 17 and 19 to the low pressure underside of the airfoils. This endwise flow of air is swept past each airfoil by the general flow of air over the wing, thus a vortex results. In the view of FIG. 1, vortex 21 rotates counterclockwise and vortex 23 rotates clockwise. It should be noted that other, smaller vortices are also generated by airfoils 16 and 18. These smaller vortices trail off downwind from various points on the trailing edge. The largest of these supplementary vortices originate from the wing roots; however, all are small in comparision to tip vortices 21 and 23.

On relatively calm days when wind speeds at the smokestack site are less than approximately 5 miles per hour, the natural buoyant ascention of stack effluents is sufficient to achieve satisfactory dispersion. However, when wind speeds reach 5 miles per hour or higher, the effluents tend to trail off downstream immediately after leaving the stack gas exit, and quickly descend to ground level resulting in frequently heavy ground level pollution as hereinabove described. Wind speeds of approximately 5 miles per hour, or higher, are also necessary for airfoils 16 and 18 to function as effective vortex generators.

As relative winds, indicated by arrows V and shown to be generally horizontal, pass over airfoils 16 and 18, tip vortices 21 and 23 are formed as hereinabove described. Stack effluent 15 flows simultaneously from stack gas exit 14 and begins to trail off downwind between vortices 21 and 23.

As vortices 21 and 23 proceed downwind, they rise due to their mutual interaction as well as increase in diameter while simultaneously forming a zone of recirculating air around both vortices which is effectively isolated from the surrounding air. At this point where vortices 21 and 23 become sufficiently large and well defined to create the above-mentioned zone of recirculating air, they may be said to converge. Stack effluents 15 flow into this convergence zone of vortices 21 and 23 due to the influence of the relative winds and thereby become entrained in the vortices and recirculating air zone.

As is well known to those skilled in the aeronautical arts, the wingtip vortices resulting from airflow over a negative lift airfoil will rise relative to the wing height. In a similar manner, vortices emanating from a positive lift airfoil descend. This ascension angle $\theta$ of vortices 21 and 23 is due to the counter rotating interaction of the vortices and is an approximate function of the airfoil angle of attack $\alpha$.

The angle of ascension is expressed by the formula $$\theta \cong \text{arc tan } 4\, C_L/\pi^3 A$$

where $C_L$ = lift coefficient of the airfoil and A = aspect ratio of the airfoil. The ascension angle of vortices 21 and 23 may thus be adjusted to achieve the desired effluent dispersion height by considering the distance over which vortices 21 and 23 remain sufficiently well defined to contain the stack effluents and varying the angle of attack $\alpha$ of airfoils 16 and 18 accordingly within the stall limitations of the airfoil sections used. The distance over which vortices 21 and 23 remain sufficiently well defined to effectively entrain stack effluents varies from 1 to approximately 3 miles, depending upon the specific atmospheric conditions extant, when wind speeds are 5 miles per hour or greater. Consequently, small angles of attack well within the stall limitation of airfoils 16 and 18 may be employed to achieve adequate dispersal heights. Adequate dispersal heights will vary from site to site; however, as a general rule, two or three times the smokestack height is adequate.

It should be noted that in the fixed adjustment embodiment of the present invention shown in FIGS. 1 and 2, the angle of attack $\alpha$ is adjusted at the time of installation to take into account the prevailing wind conditions at the smokestack height. If the prevailing winds do not blow generally horizontally, then airfoils 16 and 18 may be mounted with increased upward or downward inclination to the horizontal plane in order to achieve the desired angle of attack. Care must also be exercised to insure that the angle of attack is not so high as to result in excessive lateral drag forces during maximum wind conditions which might damage the smokestack. The angle of attack should, however, be high enough to insure adequate effluent dispersal height in lighter wind conditions. In general, most existing smokestacks are strong enough in compression to withstand the downward negative lift loads generated by the airfoils.

Airfoils 16 and 18 are mounted on smokestack 10 with a dihedral angle $\gamma$ in order to elevate airfoil wingtips 17 and 19 above stack gas exit 14 such that better entrainment of stack effluents 15 is achieved. The elevation of wingtips 17 and 19 places vortices 21 and 23 at approximately the same height as effluent plume 15, thus the effluents flow directly into the vortex convergence zone.

The controllable wing embodiment set forth in FIGS. 3, 4 and 5 function aerodynamically like the above-described fixed wing embodiment, as do all negative lift embodiments of the present invention. The controllable feature of this embodiment enables the airfoil section to be adjusted to varying wind conditions thus achieving optimum effluent dispersion and minimizing particularly damaging wing and stack loadings.

In operation, wind speed and direction is detected by sensor 104 which relays the information to an operator on the ground via cable 108, junction box 106 and cable 107. Once the threshold wind speed of 5 miles per hour is reached, the operator orients carriage 24 by means of azimuthal drive 92 which rotates carriage 24 via pinion gear 96 and ring gear 98 until the leading edges of airfoil sections 40 and 42 are facing into the relative wind. Care must be exercised to prevent rotation of carriage 24 more than 360° in order to avoid twisting power cable 107.

The angle of attack of airfoil section 40 and 42 is also manually adjusted such that a higher angle of attack is employed at lower wind speeds and a lower angle of attack is used at higher wind speeds. Toward this end, airfoil sections 40 and 42 are pivotally mounted along their spanwise axes by means of shafts 34 and 36 and along their chordal axes by means of brackets 30 and 32. Angle of attack variation is achieved by lowering or raising the inboard leading edge of airfoil sections 40 and 42 while simultaneously moving the inboard trailing edge in the opposite direction. Movement of the leading and trailing edges is accomplished by means of leading edge drive 60 and trailing edge drive 62 attached to the inboard leading and trailing edges, respectively, of airfoil sections 40 and 42 and operating through linkages comprised of drive screws, riser nuts, connecting struts and ball joints as hereinabove described. Dihedral angle adjustment is accomplished by moving both leading and trailing inboard edges either up or down simultaneously by means of leading edge drive 60 and trailing edge drive 62, thus causing airfoil sections 40 and 42 to pivot at brackets 30 and 32.

Other generally horizontal negative lift airfoil embodiments of the present invention are shown in FIGS. 6, 7, 8, 9 and 12. The embodiment shown in FIG. 6 consists of fixed angle of attack and dihedral angle airfoils 114 and 116 mounted on a rotatable carriage 110 which is provided with a vertical tail fin 124. Tail fin 124 orients airfoil sections 114 and 116 such that the leading edges 126 and 128 are perpendicular to and facing into the relative wind.

The embodiment of FIGS. 7 and 8 consists of a strut mounted swept back airfoil 130 mounted on smokestack 10 such that it faces into the prevailing winds. Airfoil 130 is mounted above the stack gas exit 14 in order to provide for better effluent entrainment. Sweepback angle $\beta$ is provided in order that the vortex generating wingtips 134 and 136 may be positioned sufficiently aft to promote good effluent entrainment while maintaining an unobstructed vertical flowpath for effluents 15 during zero wind conditions.

FIG. 9 shows an embodiment employing four airfoil sections disposed at right angles to each other and adjustable for angle of attack by suitable mechanical or hydraulic means. Airfoil sections 138 are designed for airflow from either spanwise edge, thus by adjusting the angle of attack of each individual airfoil section, the device will generate effluent entraining vortices regardless of wind direction.

The multiple airfoil embodiment connecting a plurality of smokestacks shown in FIG. 12 functions like the embodiment shown in FIGS. 1 and 2; however, the major effluent entraining vortices are generated at the wing roots 186 of the intermediate airfoil sections 170 and 172. Airfoil sections 170, 172, 174, and 176 are installed on smokestacks 10, 11 and 13 such that the airfoil leading edges 178, 180, 182 and 184 most nearly face into the prevailing winds. It should be noted that this embodiment may also be used with the variable angle of attack feature and with a dihedral angle for cantilevered airfoil sections 174 and 176.

The vertical airfoil embodiment of the present invention shown in FIGS. 10 and 11 provides for controlled lateral dispersion of effluents much as the negative lift embodiments provide controlled vertical dispersion. In this embodiment, stack effluents are entrained in the counter-rotating tip vortices produced by airfoil 148 and are deflected laterally at an angle to the free airstream direction due to vortical interaction. This lateral deflection phenomenon is dependent on the angle of attack of airfoil 148 and is similar to the upward deflection of vortices 21 and 23 in FIG. 2 at the angle of ascension $\theta$. Thus the vertical wing embodiment may be used to steer stack effluents around areas which should not be subject to high levels of pollution. It should be noted that in the vertical wing embodiment the airfoil lift loads are horizontal, thus a smokestack on which this embodiment is mounted must be capable of sustaining large lateral loads in order to prevent damage to the smokestack.

In operation, symmetrically sectioned airfoil 148 is rotatably mounted on carriage 142 and is generally oriented such that its leading edge faces into the relative wind V by vertical tail fin 152. Airfoil 148 is made to assume an angle of attack $\alpha$ with the relative wind by means of hydraulically actuated rudder 154. Rudder 154 is positioned manually from ground level by means of linkage 158 and 160 and hydraulic cylinder 156, which in turn is driven by hydraulic pump 162. Power cable 166 and slip ring 168 supply electrical power to hydraulic pump 162. Airfoil 148 may be made to assume the desired angle of attack $\alpha$ by balancing the hydraulic pressures at both ends of cylinder 156 such that rudder 154 assumes the appropriate angle. Angle of attack control may be automatic, if desired.

A device constructed according to the present disclosure therefore has the capacity to entrain and convey smokestack effluents upwards or laterally when the smokestack is subject to relative winds, in order to optimize effluent dispersal and avoid concentrated ground level pollution.

Obviously, numerous modifications of the present invention, such as application to vehicular smockstacks, are possible in light of the above teachings. It is therefore to be understood that within the scope of the appended claims the invention may be practiced otherwise than as specifically described herein.

What is claimed as new and desired to be secured by Letters Patent of the U.S. is:

1. A smokestack effluent dispersal system comprising;
a smokestack;
means located adjacent to the stack gas exit of said smokestack for producing lift component in a downwardly direction and converting the kinetic energy of relative smokestack wind into a plurality of well defined, counter-rotating vortical flows of air and entraining smokestack effluents therein for the duration of said well defined vortical flows.

2. A system as in claim 1 wherein said means for converting the kinetic energy of relative wind into vortical flow of air and entraining smokestack effluents therein comprises negative lift airfoil means.

3. A system as in claim 2 wherein said negative lift airfoil means is oriented so as to face into the prevailing relative smokestack wind.

4. A system as in claim 2 wherein said negative lift airfoil means comprises a single airfoil section mounted on and extending from the side of said smokestack.

5. A system as in claim 2 wherein said negative lift airfoil means comprises an airfoil section mounted above the stack gas exit of said smokestack on struts affixed to said smokestack.

6. A system as in claim 2 wherein said negative lift airfoil means comprises a plurality of airfoil sections having a sweepback angle between adjacent sections mounted above the stack gas exit of said smokestack on struts affixed to said smokestack.

7. A system as in claim 2 wherein said negative lift airfoil means comprises a plurality of airfoil sections mounted on and extending from the side of said smokestack.

8. A system as in claim 7 wherein said plurality of airfoil sections mounted on and extending from the side of said smokestack comprised four generally horizontal, coplanar airfoil sections designed for airflow in either direction and arranged in opposed pairs, the span axis of each of said pairs being disposed at right angles to the other.

9. A system as in claim 2 wherein said means for converting the kinetic energy of relative wind into a vortical flow of air and entraining smokestack effluents therein further comprises means for varying the angle of attack and means for varying the dihedral angle of said negative lift airfoil means and means for varying the orientation of said negative lift airfoil means about the vertical axis in order to keep the airfoil pointed into the relative wind.

10. A system as in claim 9 wherein said means for varying the orientation of said negative lift airfoil means about the vertical axis comprises a base means attached to said smokestack by anti-friction bearing means and having said airfoil and a vertical tail fin mounted thereon.

11. A system as in claim 9 wherein said negative lift airfoil means comprises a pair of airfoil sections mounted in opposition such that each of said airfoil sections is free to rotate throughout a limited arc about the spanwise and wing root chordal axes, and wherein said means for varying the angle of attack and dihedral angle of said negative lift airfoil comprises a leading edge drive means connected to the inboard leading edges of said pair of airfoil sections and a trailing edge drive means connected to the inboard trailing edges of said pair of airfoil sections for purposes of raising and lowering said inboard leading and trailing edges of said pair of airfoil sections; and wherein said means for varying the orientation of said negative lift airfoil about the vertical axis comprises a rotatable base means upon which said opposed pair of airfoil sections are mounted, attached to said smokestack by means of a plurality of anti-friction bearings; and a drive means for varying the azimuthal orientation of said base means.

12. A system as in claim 11 whenever said leading edge drive means comprises a reversible motor drivingly connected to a screw shaft which threadably engages a nut connected to said airfoil section inboard leading edges by means of a plurality of ball points and connecting links wherein said nut is rotatively constrained and free to translate axially relative to said drive screw, and said trailing edge drive means comprises a reversible motor drivingly connected to a screw shaft which threadably engages a nut connected to said airfoil section inboard trailing edges by means of a plurality of ball joints and connecting links wherein said nut is rotatively constrained and free to translate axially relative to said drive screw; and wherein said drive means for varying the azimuthal orientation of said base means comprises a reversible motor mounted on said base means and drivingly connected to a pinion gear which drivingly engages a ring gear through an aperture in said base means, said ring gear being fixedly mounted on said smokestack.

13. A system as in claim 2 wherein said negative lift airfoil means comprises two airfoil sections mounted on and extending from the side of said smokestack and further includes means for varying the angle of attack of said airfoil section and means for varying the dihedral angle between said airfoil sections.

14. A system as in claim 2 further comprising a plurality of juxtapositional smokestacks wherein said negative lift airfoil includes a plurality of airfoil sections mounted on and extending between said plurality of smokestacks.

15. A system as in claim 2 further comprising a plurality of juxtapositional smokestacks in approximate alinement wherein said negative lift airfoil includes a plurality of airfoil sections mounted on and extending between said plurality of smokestacks in order of the alinement of said smokestacks and further includes a single, cantilevered airfoil mounted on and extending from each end smokestack of said plurality of smokestacks.

16. A smokestack effluent dispersal system comprising:

a smokestack;

means located adjacent to the stack gas exit of said smokestack for converting the kinetic energy of relative smokestack wind into a plurality of well defined, counter-rotating vortical flows of air and entraining smokestack effluents therein for the duration of said well defined vortical flows;

said means located adjacent to the stack gas exit of said smokestack for converting the kinetic energy of relative smokestack wind into a plurality of well defined, counter-rotating vortical flows of air and entraining smokestack effluents therein comprises a substantially vertical airfoil means mounted over the gas exit of said smokestack.

17. A system as in claim 16 further comprising means for varying the angle of attack of said vertical airfoil means.

18. A system as in claim 17 wherein said means for varying the angle of attack of said vertical airfoil means comprises a rotatable base means mounted on said smokestack by means of anti-friction bearing means and having said vertical airfoil and a vertical rudder equipped tail fin mounted thereon.

19. A method of improving the effluent dispersal of a smokestack subject to relative winds comprising the steps of:

providing a smokestack, providing a vortex generating device for producing lift component in a downwardly direction for converting the kinetic energy of said relative winds into a plurality of well-defined vortical flows of air, placing said vortex generating device in the flow path of said relative winds and adjacent to the stack gas exit of said smokestack;

entraining said stack effluents in said well-defined vortical flows of air, and varying the orientation of said vortex generating device to said relative winds in order to vary the flow direction of said well-defined vortical flows of air.

20. The method of claim 19 further comprising:

positioning said vortex generating device generally horizontally such that the leading edge thereof is facing into the relative wind; varying the angle with respect to said smokestack of said vortex generating device, hence varying tip height thereof relative to the stack gas exit of said smokestack, in order to optimize entrainment of said effluents; and varying the angle of attack between said vortex generating device and said relative winds in order to vary the angle of ascension of said vortical flows of air and in order to vary lateral drag loads on said smokestack.

21. The method of claim 19 further comprising:

positioning said vortex generating device vertically such that the leading edge thereof is facing into the relative wind; and varying the angle of attack between said vortex generating device and said relative winds in order to vary the direction of flow of said vortical flows of air and in order to vary lateral drag loads on said smokestack.

* * * * *